US009067307B2

(12) United States Patent
Kozak

(10) Patent No.: US 9,067,307 B2
(45) Date of Patent: Jun. 30, 2015

(54) HEXA-LOBED HEAD BIT

(71) Applicant: Burton Kozak, Chicago, IL (US)

(72) Inventor: Burton Kozak, Chicago, IL (US)

( * ) Notice: Subject to any disclaimer, the term of this patent is extended or adjusted under 35 U.S.C. 154(b) by 157 days.

(21) Appl. No.: 13/705,374

(22) Filed: Dec. 5, 2012

(65) Prior Publication Data

US 2014/0150613 A1 Jun. 5, 2014

(51) Int. Cl.
*B25B 15/00* (2006.01)

(52) U.S. Cl.
CPC ..... *B25B 15/005* (2013.01)

(58) Field of Classification Search
CPC .. B25B 15/004; B25B 15/005; B25B 15/008; B25B 23/0035; B25B 23/00364; B25B 23/1415
USPC ..... 81/436, 437, 460, 471
See application file for complete search history.

(56) References Cited

U.S. PATENT DOCUMENTS

| | | | | |
|---|---|---|---|---|
| 5,868,047 | A * | 2/1999 | Faust et al. | 81/438 |
| 6,352,011 | B1 * | 3/2002 | Fruhm | 81/438 |
| 7,168,348 | B2 * | 1/2007 | Holland-Letz | 81/460 |
| 7,225,710 | B2 * | 6/2007 | Pacheco, Jr. | 81/460 |
| 8,166,851 | B2 * | 5/2012 | Pchola et al. | 81/460 |
| 8,262,670 | B2 * | 9/2012 | Laubert et al. | 606/104 |
| 8,291,795 | B2 * | 10/2012 | Hughes et al. | 81/460 |
| 8,347,768 | B2 * | 1/2013 | Witte | 81/443 |
| 8,418,587 | B2 * | 4/2013 | DeBaker | 81/436 |
| 8,549,962 | B2 * | 10/2013 | Werner et al. | 81/460 |
| 8,616,097 | B2 * | 12/2013 | Hughes et al. | 81/460 |
| 8,800,407 | B2 * | 8/2014 | DeBaker | 76/108.1 |
| 2010/0037737 | A1 * | 2/2010 | Pchola et al. | 81/460 |
| 2011/0197721 | A1 * | 8/2011 | DeBaker | 81/436 |
| 2011/0217143 | A1 * | 9/2011 | Hughes et al. | 411/407 |
| 2011/0283842 | A1 * | 11/2011 | Lai | 81/460 |
| 2011/0283843 | A1 * | 11/2011 | Werner et al. | 81/461 |
| 2012/0006160 | A1 * | 1/2012 | Wang | 81/438 |
| 2012/0285301 | A1 * | 11/2012 | Totsu | 81/460 |
| 2013/0011216 | A1 * | 1/2013 | Frank | 411/403 |
| 2013/0091991 | A1 * | 4/2013 | Lee et al. | 76/119 |
| 2013/0118323 | A1 * | 5/2013 | Witte | 81/443 |
| 2013/0160616 | A1 * | 6/2013 | Hughes et al. | 81/460 |
| 2013/0276596 | A1 * | 10/2013 | Lin | 81/460 |
| 2013/0340578 | A1 * | 12/2013 | Lai | 81/460 |
| 2014/0102264 | A1 * | 4/2014 | Werner et al. | 81/436 |

* cited by examiner

*Primary Examiner* — David B Thomas
(74) *Attorney, Agent, or Firm* — Factor Intellectual Property Law Group, Ltd.

(57) ABSTRACT

A hexa-lobed headed bit having a hexa-lobed shaped head having a first length, a first width and grooves and protrusions, the grooves and protrusions extending along substantially the entire length of the head, the bit further including a shaft having a second length and a second width, the second width being greater that the first width, the shaft being connected to the head via a shoulder which may be sloped to gradually widen the first width to the second width and having grooves and protrusions extending along the shoulder, the shoulder grooves and protrusions substantially continuing from the grooves and protrusions extending along substantially the entirety of the length of the head.

11 Claims, 1 Drawing Sheet

HEXA-LOBED HEAD BIT

RELATED APPLICATIONS

None.

TECHNICAL FIELD

The present invention generally relates to hexa-lobed head bits for use with hexa-lobed head fasteners and the like. More specifically, the present invention relates to a hexa-lobed head bit which has a grooved, tapered head and shoulder, and a shaft having a curved, indented portion.

FEDERALLY SPONSORED RESEARCH OR DEVELOPMENT

None.

BACKGROUND OF THE INVENTION

Bits for use with hand and power tools have been known and used for many years. Known bits may have various heads or cutting edges to interact with particular fasteners or cut particularly sized holes or angles in a given material. For example, such tool bits may include a flathead or Phillips head for interacting with a screw. One particular tool bit configuration known and used in the art is a hexa-lobed head bit. A hexa-lobed head bit generally includes a star-like head having six-points and is configured to be inserted into a fastener having a receptacle matching in both shape and size. When inserted into a matching fastener, the hexa-lobed head bit may be rotated to tighten and loosen the fastener as needed. Known hexa-lobed head bits generally include the hexa-lobed configuration down only a portion of the head or tip of the bit before the head or tip becomes uniform and smooth. The uniform and smooth portion of the head or tip of the bit then ends abruptly at a shoulder forming the top end of the bit shaft, with the shoulder having a substantially greater diameter and circumference than the head or tip of the bit.

When using tool bits having certain edges, like for example cutting edges, collars may be utilized to control the depth the bit or fastener being inserted by the bit may be inserted into a given material. Collars may be used to prevent an oversized or overly deep hole from being drilled into a material, or to prevent a fastener from being applied too tight and potentially damaging the surface of the material into which the fastener is being inserted. In order to realize the advantages of some collars, it is important to insure that collars pinch or lock in place on the bit to insure that the collar rotates with the bit and holds in place, preventing the head and/or tip of the bit from moving laterally in the collar. If the collar is properly locked onto the bit, the full benefit of the collar is realized and the material which is being drilled or fastened is protected and the bit will maintain a substantially constant alignment while being used.

While collars have been used with fastening bits, because of the present configuration of hexa-lobed head bits and in particular the heads or tips, shoulders and shafts of known hexa-lobed head bits, collars known in the art may not lock in place. The configuration of known hexa-lobed head bits may cause any collar attached thereto to shift, slip or disengage during use, allowing the bit and fastener being fastened by the bit to over penetrate and damage the material, or prevent the bit from extending far enough, creating an only partially fastened or completely unfastened portion.

Therefore, it would be advantageous to design a hexa-lobed head bit capable of allowing multiple collars to lock and pinch in place in a manner which prevents the collars from disengaging or otherwise shifting when placed on the hexa-lobed head bit.

It would also be advantageous if such a hexa-lobed head bit was capable of flexing, to allow the bit head to remain in contact with an associated fastener as the fastener is rotated and moved.

It would also be advantageous if the hexa-lobed head bit had built in shock absorption to extend bit life.

The present invention is provided to solve these and other issues.

SUMMARY OF THE INVENTION

Accordingly, the present invention is directed to a hexa-lobed head bit having at least a fully contoured head or tip and shoulder configured to receive and lock a collar into place.

According to one aspect of the invention a hexa-lobed headed bit is provided. The bit includes hexa-lobed shaped head or tip which has a first length, a first width, grooves and protrusions. The grooves and protrusions extend along substantially the entire length of the head or tip, from proximate the uppermost portion of the head to approximately the base or lowermost portion. The hexa-lobed headed bit also includes a shaft having a second length and a second width, the second width being greater that the first width —i.e. the shaft is wider than the head. A shoulder connects the head to the shaft. The shoulder is gradually sloped so that the head or tip width gradually increases to the shaft width. The shoulder also includes grooves and protrusions extending along substantially the entire length of the shoulder. The shoulder grooves and protrusions may substantially continue from the grooves and protrusions extending along substantially the entirety of the length of the head so as to allow the shoulder grooves and protrusions to align with the head or tip grooves or protrusions.

According to another aspect of the invention, the protrusions extending along the shoulder may have at least one, and in some cases at least two, contours. The at least one or two contours of the protrusions extending along the shoulder may be capable of cooperating with a collar to hold the collar in place when attached to the bit.

According to another aspect of the invention, the head and shoulder grooves and protrusions may act as shock absorbers to reduce vibrations and shock when the hexa-lobed head bit is engaged and in use.

According to another aspect of the invention, the shaft may include an indented portion extending along a portion of the length of the shaft. The indented portion may have a concavely-curved or inwardly-radial shape, wherein a width of the indented portion is less than the second width at any point along the curve radius. The indented portion may allow the shaft to flex. The indented portion may be located anywhere along the length of the shaft, including proximate an opposite end of the shaft than that of the head and shoulder.

According to another aspect of the invention, the protrusions extending along substantially the entire length of the head may become wider as the protrusions approach the shoulder. In addition to becoming wider, the protrusions extending along substantially the entire length of the head may protrude from the head a lesser amount as the protrusions approach the shoulder. As the grooves and protrusions extend over the shoulder, the grooves may become wider proximate the area where the head connects to the shoulder.

Other advantages and aspects of the present invention will become apparent upon reading the following description of the drawings and detailed description of the invention.

DETAILED DESCRIPTION OF PREFERRED EMBODIMENTS

While this invention is susceptible to embodiments in many different forms, there is described in detail herein, preferred embodiments of the invention with the understanding that the present disclosures are to be considered as exemplifications of the principles of the invention and are not intended to limit the broad aspects of the invention to the embodiments illustrated.

Figure 1:
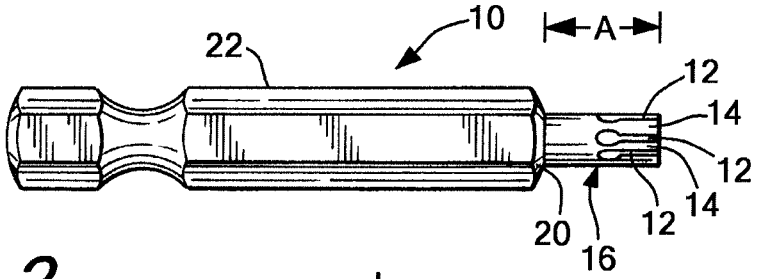
FIG. 1 PRIOR ART
FIG. 1 shows a side view of a prior art hexa-lobed head bit.

As seen in FIG. 1, in prior art hexa-lobed head bits 10, the grooves 12 and protrusions 14 forming the engagement portion of bit head 16 are generally uniform, generally extend only part way along the length A of the head. The base of the head generally includes smooth portion 18 and ends abruptly at shoulder 20 which is immediately as wide as shaft 22. Prior art bits configured like that shown in FIG. 1 may not allow a collar or similar structure to properly attach, allowing the collar to disconnect or slip, causing the collar to fail, causing the Torx bit to fail to properly engage a cooperating fastener, or causing the hexa-lobed bit to inadvertently penetrate the fastener too deep within a material and damage the material, the fastener, or the surface of the material. Additionally, with a solid bit head like in the prior art bits, the entire vibration resulting from the use of the bit is received by the bit head, which may cause damage and wear on the head and prematurely cause the hexa-lobed head to wear down and fail.

In order to alleviate the collar connection problem and insure that any collars attached to a hexa-lobed head bit lock in place and the material into which a cooperating fastener is inserted is protected, the present invention is directed to a hexa-lobed head bit having a head or tip with a width and length, the head or tip having grooves and protrusions extending along substantially its entire length. The grooves and protrusions may continue through a curved or sloped shoulder which gradually expands out to the width of a bit shaft, the shaft being wider than the head or tip.

Figure 2:
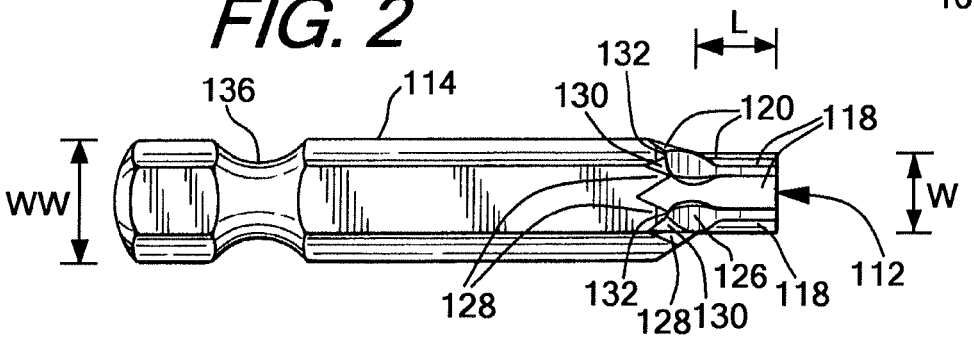
FIG. 2 shows a side view of a hexa-lobed head bit as contemplated by the present invention.
Figure 3:
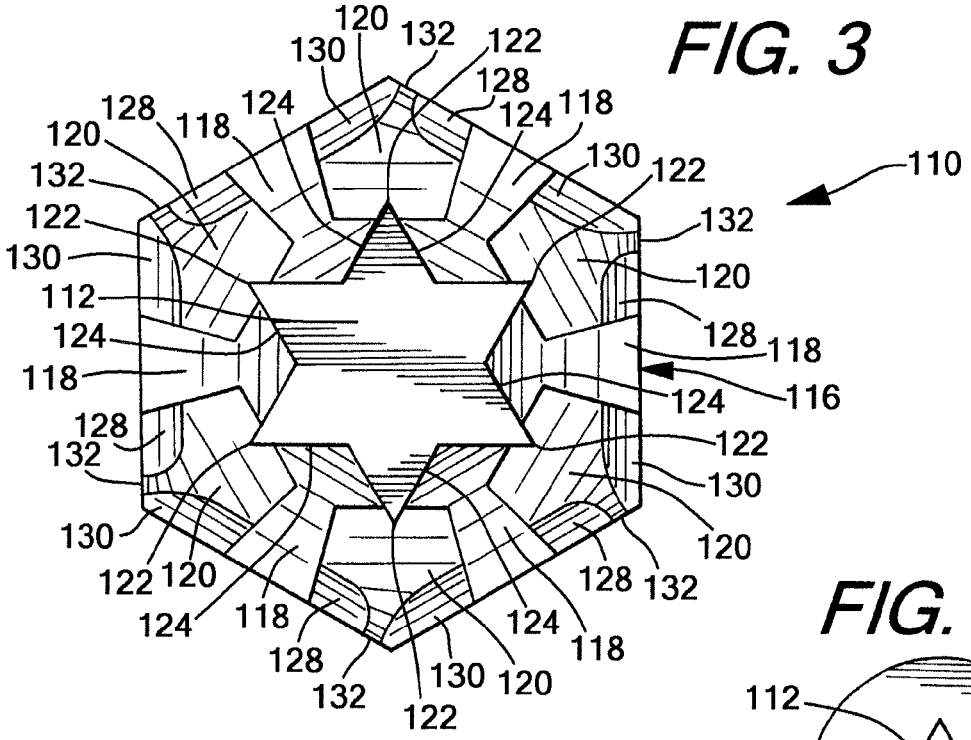
FIG. 3 shows a top view of the hexa-lobed head bit of FIG. 2.

FIG. 2 shows a side view of a hexa-lobed head bit as contemplated by the invention. As seen in FIG. 2, hexa-lobed head bit 110 includes head or tip 112 connected to shaft 114 via shoulder 116. Head 112 is generally cylindrical in shape and has a width W and a length L. Head 112 includes a set of six substantially similar grooves 118 and six substantially similar protrusions 120 which alternate and extend downwards along substantially the entire length L of head 112. Grooves 118 and protrusions 120 begin proximate the top of head 112 and correspond to the hexa-lobed configuration shown in FIG. 3 —each protrusion 120 corresponds to a point 122 on the "star-like" hexa-lobed head while each groove 118 corresponds to an indent 124 between each point.

Protrusions 120 extend downwards along length L of head 112 and approaches shoulder 116. The protrusions may begin to become wider and flatter, i.e. protrude outward a shorter distance from grooves 118 and head 112, proximate portion 126 of each protrusion. As protrusions 120 extend over shoulder 116, each protrusion may briefly maintain the wider width and flatter protrusion before finally continuing to widen and protruding further from the shoulder proximate the uppermost portion of shaft 114.

As each protrusion extends over shoulder 116, at least one, and as seen in FIG. 2, two distinct contours 128, 130 may be formed in the surface of the protrusion. These contours may be identical or different in shape, and may be separated by an elevated segment 132. Contour 130 may be substantially aligned with an edge line on shaft 114 of the bit, while contour 128 may be located on a face or side of the bit shaft. Contours 128, 130 may be used to hold and lock into place any collars or similar structures which may be placed overtop at least a portion of bit 110. Collars may include, for example, a depth collar which may be used to prevent any hexa-lobed headed fastener from penetrating to far into a material and/or prevent the head of the fastener from damaging the surface of the material. For example, the collars may prevent a fastener inserted and fastened by a hexa-lobed head bit into a piece of dry wall or on a deck board from tearing the paper surface on the drywall, or splintering the surface of a deck board, as a result of a bit or fastener over penetrating or torqueing when being inserted into a material.

Like protrusions 120, grooves 118 may also extend along substantially the entire length L of head 112 and over shoulder 116, terminating proximate the uppermost portion of shaft 114. While extending along the length L of head 112, in embodiments where protrusions 120 widen and/or flatten proximate area 126, grooves 118 may become narrower and shallower in response to the changing protrusions. As the shoulder begins to slope and widen the bit, the grooves may also begin to widen, effectively covering at least a portion of the new surface formed by the widening bit. If the protrusions protrude further from the head and/or shoulder as they extend over the shoulder, the shoulder groove portion may become deeper.

The combination of grooves 118 and protrusions 120 may act as shock absorbers to lengthen the life of the tip of the hexa-lobed headed bit. As a result of the protrusions extending along the entire length L of the tip or head, as the tip or head engages and inserts a fastener into a material, the protrusions may flex or vibrate in the grooves and absorb the resulting vibrations. Rather than be a solid structure which imparts the entire vibration on the tip or head, the protrusions receive and diffuse and dampen the vibrations, protecting the tip or head, extending the tip or head life.

In addition to having grooves and protrusions, which in some embodiments may include one or more contours, shoulder 116 may also be sloped or curved to gradually widen the width W of head 112 to a larger width WW of shaft 114 to further insure any applied collars are locked in place. The sloped and curved shoulder, along with the grooves and protrusions, and any contours, help fix a collar in place, preventing the collar from disengaging or slipping, allowing for the hexa-lobed head to properly engage a cooperating fastener while protecting the underlying material.

In order to further insure that the hexa-lobed head maintains proper engagement with a cooperating fastener, shaft 114 may include an indented or recessed portion 136 to allow the shaft to flex when necessary. Portion 136 may have an inwardly-radial or concavely-curved surface which reduces bit width throughout the indented or recessed portion—any point along the radius or curvature of the portion will have a width less than the shaft. The reduced width may allow the shaft to flex, allowing the bit head to maintain engagement with a fastener should the bit, tool, or collar be slightly adjusted as the fastener is inserted into a material.

Figure 4B:
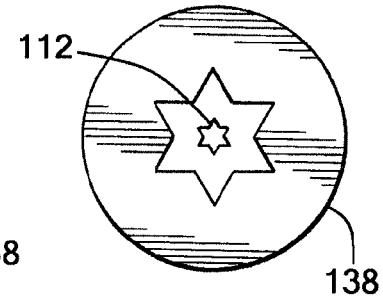
FIG. 4A shows a side view of the hexa-lobed head bit of FIG. 2 with a collar attached thereto; and, FIG. 4B shows a top view of the hexa-lobed head bit of FIGS. 2 and 3 having a collar attached thereto.
Figure 4A:
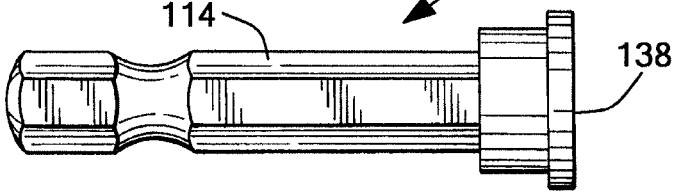

An example of a hexa-lobed headed bit having a collar attached thereto as contemplated by the invention may be seen, for example in FIGS. 4A and 4B. As seen in FIGS. 4A and 4B, collar 138 may be fixed in place at the end of bit 110 so as to allow only a small portion of head or tip 112 to extend there from. As a fastener is inserted into a material using bit 110 with collar 138 attached, collar 138 will eventually contact the surface of the material the fastener is being inserted into, preventing the bit from inserting a cooperating fastener any further.

Though collar 138 may be held in place using grooves 118, protrusions 120, and contours 128, 130, collar 138 may be removed and replaced by collars of varying lengths to allow more or less extension of head or tip 112 from the collar to allow bit 110 to insert a fastener more or less into a material. This may allow for shorter collars to be used if more head extension is required to fasten a longer fastener to insure the longer fastener is fully inserted into the material. The shorter collar may be removed and replaced with a longer collar in order to insert a shorter fastener to insure the shorter fastener is not over inserted or torqued from too much head or tip extension.

While in the foregoing there has been set forth a preferred embodiment of the invention, it is to be understood that the present invention may be embodied in other specific forms without departing from the spirit or central characteristics thereof. The present embodiments, therefore, are to be considered in all respects as illustrative and not restrictive, and the invention is not to be limited to the details given herein. While specific embodiments have been illustrated and described, numerous modifications come to mind without significantly departing from the characteristics of the invention and the scope of protection is only limited by the scope of the accompanying claims.

What is claimed is:

1. A hexa-lobed headed bit comprising:

a hexa-lobed shaped head having a first length, a first width, grooves and protrusions, the grooves and protrusions extending along substantially the entire length of the head;

a shaft having a second length and a second width, the second width being greater that the first width;

a shoulder connecting the head to the shaft, the shoulder being sloped to gradually widen the first width to the second width; and, having grooves and protrusions extending along substantially an entire length of the shoulder, the shoulder grooves and protrusions substantially continuing from the grooves and protrusions extending along substantially the entirety of the length of the head.

2. The hexa-lobed headed bit of claim 1 wherein the protrusions extending along the shoulder have at least one contour.

3. The hexa-lobed headed bit of claim 2 wherein the protrusions extending along the shoulder have at least two contours.

4. The hexa-lobed headed bit of claim 3 wherein the at least two contours of the protrusions extending along the shoulder are capable of cooperating with a collar to hold the collar in place when attached to the bit.

5. The hexa-lobed headed bit of claim 1 wherein the shaft includes an indented portion extending along a portion of the length of the shaft, the indented portion having a radial shape wherein a width of the indented portion is less than the second width at any point along the radius.

6. The hexa-lobed headed bit of claim 5 wherein the indented portion allows the shaft to flex.

7. The hexa-lobed headed bit of claim 5 wherein the indented portion is located on an opposite end of the shaft than the head and shoulder.

8. The hexa-lobed headed bit of claim 1 wherein the protrusions extending along substantially the entire length of the head become wider as the protrusions approach the shoulder.

9. The hexa-lobed headed bit of claim 8 wherein the protrusions extending along substantially the entire length of the head protrude less as the protrusions approach the shoulder.

10. The hexa-lobed headed bit of claim 8 wherein the grooves become wider proximate the portion where the head connects to the shoulder.

11. The hexa-lobed headed bit of claim 1 wherein the grooves and protrusions act to dampen vibrations resulting from use of the bit.

* * * * *